US008261390B2

(12) United States Patent
Lee et al.

(10) Patent No.: US 8,261,390 B2
(45) Date of Patent: Sep. 11, 2012

(54) DRUM TYPE WASHING MACHINE HAVING TOWEL WASHING FUNCTION AND OPERATION METHOD THEREOF

(75) Inventors: Deug-Hee Lee, Changwon-si (KR); Pyoung-Hwan Kim, Changwon-si (KR); Eun-Jin Park, Changwon-si (KR); Hyung-Yong Kim, Changwon-si (KR); Seong-Hae Jeong, Changwon-si (KR)

(73) Assignee: LG Electronics Inc., Seoul (KR)

( * ) Notice: Subject to any disclaimer, the term of this patent is extended or adjusted under 35 U.S.C. 154(b) by 698 days.

(21) Appl. No.: 12/230,805

(22) Filed: Sep. 4, 2008

(65) Prior Publication Data

US 2009/0094760 A1 Apr. 16, 2009

(30) Foreign Application Priority Data

Sep. 5, 2007 (KR) ..... 10-2007-0090124

(51) Int. Cl.
*D06F 35/00* (2006.01)

(52) U.S. Cl. ..... 8/158; 8/159; 68/3 R

(58) Field of Classification Search ..... None
See application file for complete search history.

(56) References Cited

U.S. PATENT DOCUMENTS

| | | | | |
|---|---|---|---|---|
| 4,555,019 | A | 11/1985 | Spendel | |
| 5,144,819 | A | 9/1992 | Hiyama et al. | |
| 2002/0128729 | A1 | 9/2002 | Blair et al. | |
| 2003/0024056 | A1 | 2/2003 | Kim et al. | |
| 2004/0139558 | A1 * | 7/2004 | Kim et al. | 8/159 |
| 2006/0248658 | A1 * | 11/2006 | Ha et al. | 8/147 |

FOREIGN PATENT DOCUMENTS

| | | | |
|---|---|---|---|
| DE | 4210577 | | 10/1993 |
| EP | 1 627 945 | | 2/2006 |
| EP | 1719832 | A1 * | 11/2006 |
| JP | 2000-037586 | | 2/2000 |
| KR | 1996-0023415 | | 7/1996 |
| KR | 10-2007-0015682 | A | 2/2007 |

* cited by examiner

*Primary Examiner* — Michael Barr
*Assistant Examiner* — Jason Ko
(74) *Attorney, Agent, or Firm* — McKenna Long & Aldridge LLP

(57) ABSTRACT

Disclosed is the operation method for a towel-washing course in a washing machine, in which the towel is dehydrated at the spin speed of 900 rpm and 1100 rpm, which is greater than the spin speed (800 rpm) of the drum in the main dehydration process for general laundry, a water level of 22 kHz or 23 kHz, higher than a water level (23.2 kHz) for the general laundry, is supplied to the towel, the towel has a rinse time of 8 or 12 minutes, which is longer than that of 4 minutes for the general laundry, and rinse temperature for the towel is in the range of 50° C.~60° C., relatively higher than that of 40° C. used to rinse the general laundry. Further, the rinse process having the remaining water removal process is performed between the main dehydration and the water supply, thereby removing detergent solution with a certain concentration from the inside of the washing machine after completing the main dehydration process. Accordingly, clean water is supplied, thereby smoothing the rinse process for the towel, thus to solve the problem of detergent remnants in the towel after rinsing the towel.

3 Claims, 3 Drawing Sheets

[Fig. 1]
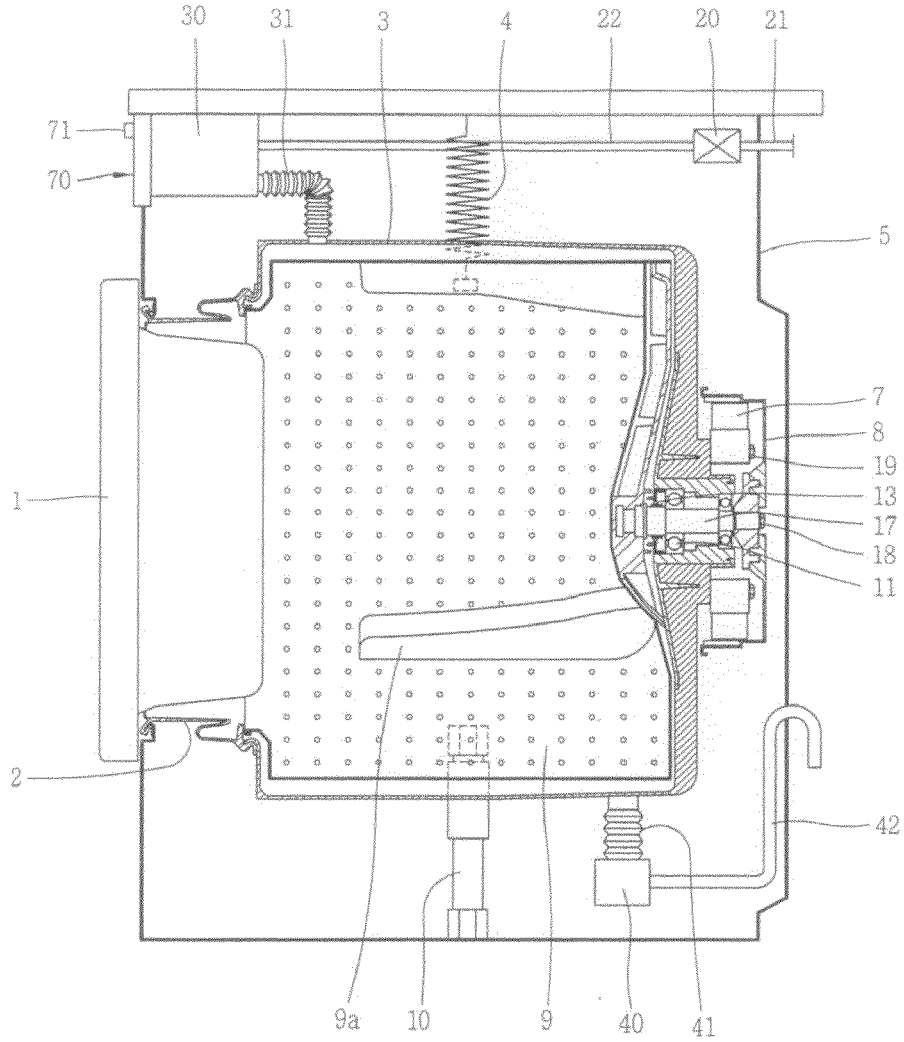
[Fig. 2]
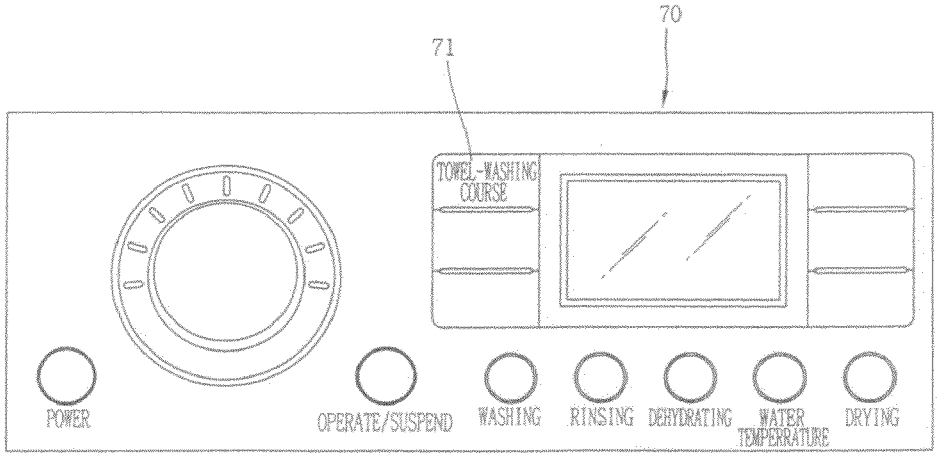

[Fig. 3]
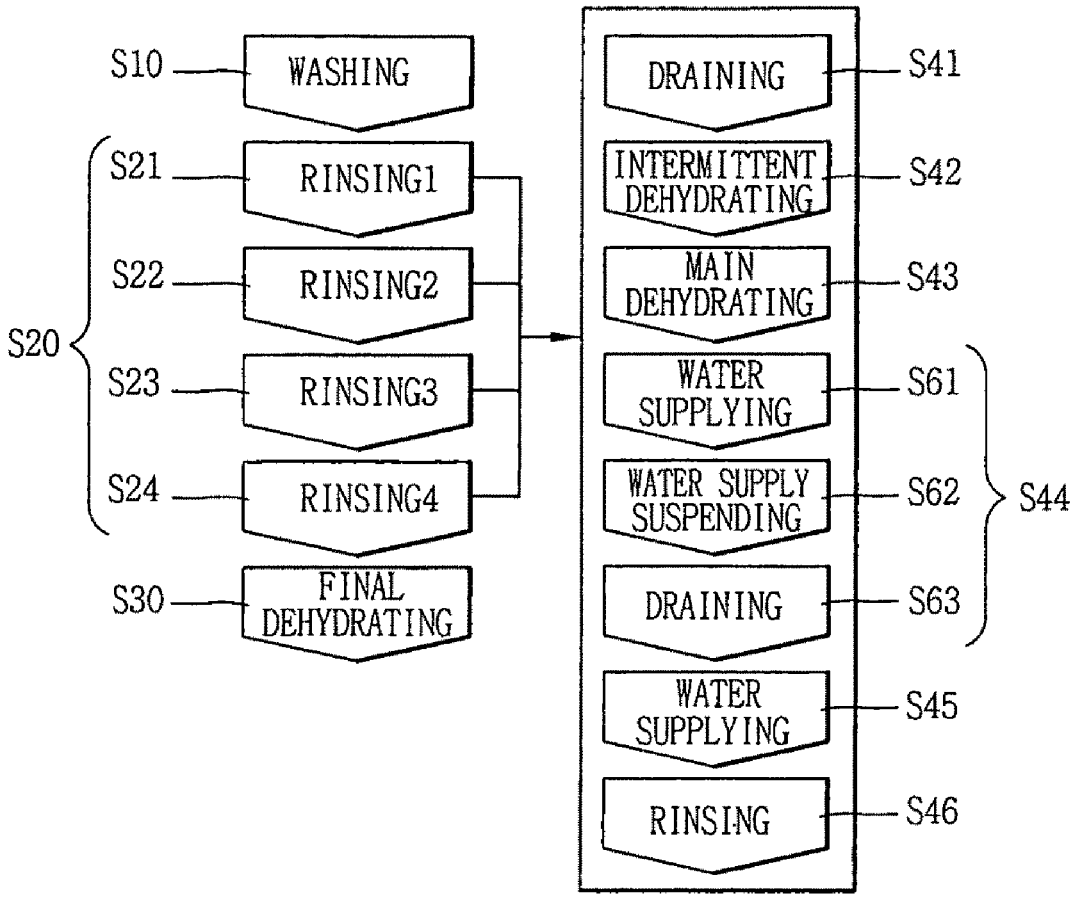

[Fig. 4]
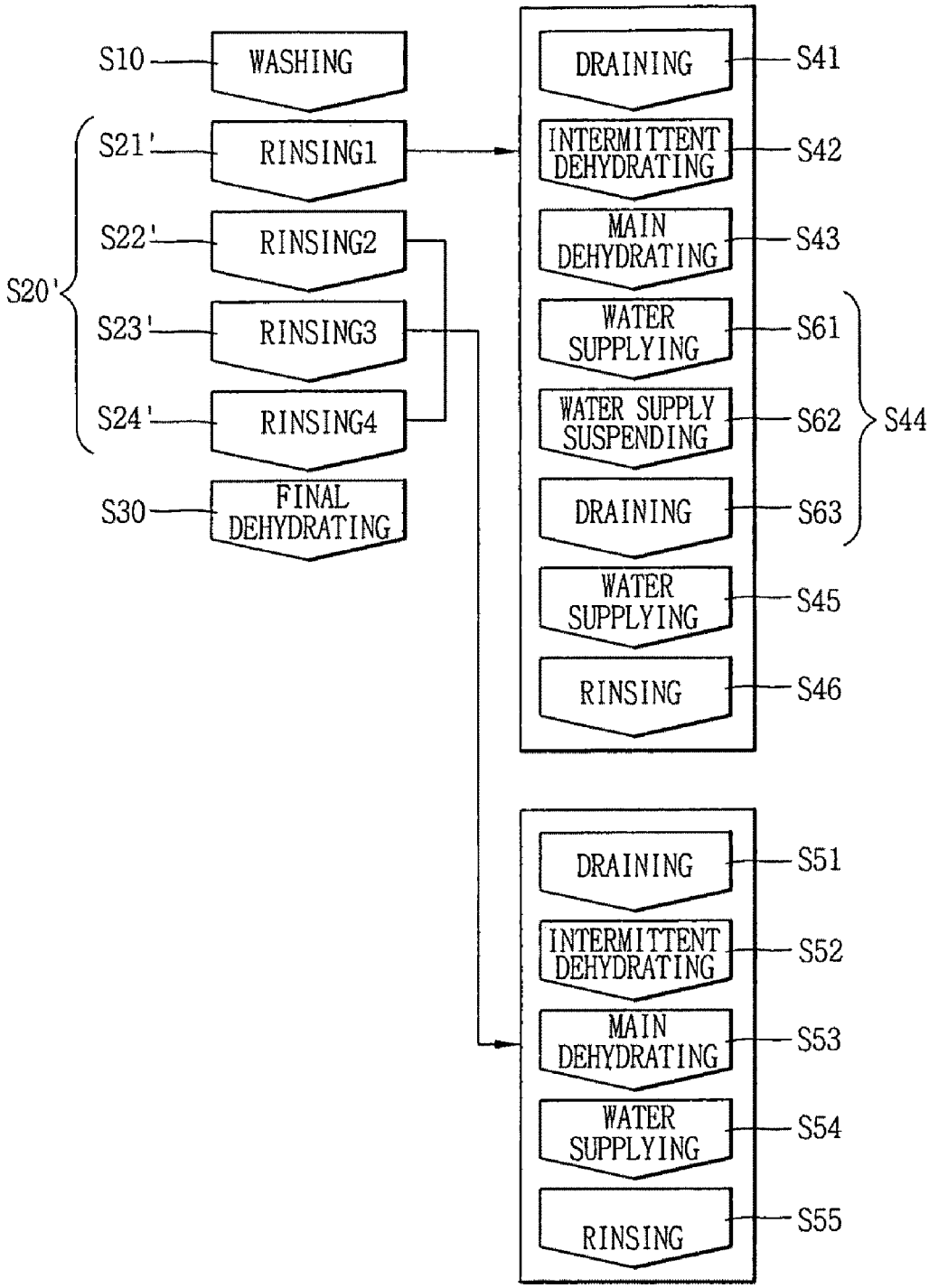

DRUM TYPE WASHING MACHINE HAVING TOWEL WASHING FUNCTION AND OPERATION METHOD THEREOF

RELATED APPLICATION

The present disclosure relates to subject matter contained in priority Korean Application No. 10-2007-0090124, filed on Sep. 5, 2007, which is herein expressly incorporated by reference in its entirety.

BACKGROUND OF THE INVENTION

1. Field of the Invention

The present invention relates to a drum type washing machine having a towel washing function and an operation method thereof.

2. Background of the Invention

In general, an operation method for a washing machine may include a washing process for washing laundry, a rinse process for supplying water or circulating water so as to rinse the laundry after performing the washing process, and a dehydration process for dehydrating the laundry after performing the rinse process.

In the rinse process, while clean water is supplied to the laundry, steps of water supply, intermittent dehydration and main dehydration are sequentially performed. In addition, in order to enhance the rinsing effect, the rinse process may be repeated for plural times between the washing process and the dehydration process.

Meanwhile, if laundry is a towel, the towel contains a relatively large percentage of detergent even after being rinsed, when compared to general types of laundry.

This is because the towel is manufactured by a weave technique which uses a manual or power loom to weave two groups of threads perpendicular to each other, thereby easily containing the detergent therein.

Accordingly, if the towel is rinsed by the same method as the general laundry, the rinse process for the towel cannot be smoothly performed, thus to cause a problem of having detergent remnants in the towel even after being rinsed.

SUMMARY OF THE INVENTION

Therefore, an object of the present invention is to provide an operation method for a towel-washing course in a washing machine with an enhanced rinsing performance for the towel.

Another object of the present invention is to provide a washing machine, which enables to select an option for a towel-washing course.

In addition, another object of the present invention is to provide a drum type washing machine having a towel-washing function.

To achieve these and other advantages and in accordance with the purpose of the present invention, as embodied and broadly described herein, there is provided an operation method for a towel-washing course in a washing machine, including: a pressing process for pressing a towel-washing course button; a washing process for washing a towel; a rinse process for rinsing the towel by supplying water after performing the washing process, and including a remaining water removal process; and a final dehydration process for dehydrating the towel after performing the rinse process.

Preferably, the rinse process is repeated for plural times between the washing process and the final dehydration process. Preferably, the remaining water removal process is included in all of the rinse process repeated for plural times or only in a first rinse process among the rinse process repeated for plural times.

Preferably, the remaining water removal process is performed in an order of water supply, water supply suspension, and drain.

Preferably, a spin speed of a drum in the main dehydration process is in the range of 900 rpm (revolutions per minute) and 1100 rpm, a water level of 22 kHz or 23 kHz is supplied in the water supply step, a rinse time in the rinse process is for 8 or 12 minutes, and rinse temperature in the rinse process is in the range of 50° C. and 60° C.

To achieve these and other advantages and in accordance with the purpose of the present invention, as embodied and broadly described herein, there is provided a washing machine having a towel-washing course button which enables to select an option for a towel-washing course.

To achieve these and other advantages and in accordance with the purpose of the present invention, as embodied and broadly described herein, there is provided a drum type washing machine, including: a cabinet forming an external appearance; a tub disposed inside the cabinet and containing washing water; a drum rotatably mounted inside the tub and receiving laundry; a water supply unit having a plurality of valves for supplying or suspending water to the tub; and a control panel for receiving an inputting of a manipulation command from a user so as to control an entire operation of a washing machine, wherein the control panel includes a towel-washing course button which enables to select an option for a towel-washing course if laundry is a towel.

Preferably, if the towel washing-course button is pressed, a washing process for washing a towel, a rinse process for supplying water so as to rinse the towel after performing the washing process and having a remaining water removal process, and a final dehydration process for dehydrating the towel after performing the rinse process are performed. Here, in the rinse process, steps of drain, intermittent dehydration, main dehydration, the remaining water removal process, water supply, and rinse are sequentially performed.

Preferably, a spin speed of the drum in the main dehydration process is in the range of 900 rpm and 1100 rpm, a water level of 22 kHz or 23 kHz is supplied in the water supply step, a rinse time in the rinse process is for 8 or 12 minutes, and rinse temperature is in the range of 50° C. and 60° C. in the rinse process.

In addition, the rinse process is repeated for plural times between the washing process and the final dehydration process, and preferably, the remaining water removal process is performed only in a first rinse process, which has the highest content of detergent remnants, among the rinse process that are repeated for plural times.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 1 is a schematic view of a drum type washing machine driven by an operation method for a towel-washing course according to a first embodiment of the present invention;

FIG. 2 is an exemplary view of a control panel having a towel-washing course button in FIG. 1;

FIG. 3 is a block diagram showing the operation method for the towel-washing course according to the first embodiment of the present invention; and FIG. 4 is a block diagram showing an operation method for the towel-washing course according to a second embodiment of the present invention.

DETAILED DESCRIPTION OF THE INVENTION

Description will now be given in detail of the preferred embodiments of the present invention, examples of which are illustrated in the accompanying drawings.

Hereinafter, description of the operation method for a towel-washing course in a washing machine will be given in detail according to the preferred embodiments of the present invention. FIG. 1 is a schematic view of a drum type washing machine driven by an operation method for a towel-washing course according to a first embodiment of the present invention, and FIG. 2 is an exemplary view of a control panel having a towel-washing course button in FIG. 1.

Referring to FIG. 1, the drum type washing machine driven by the operation method for the towel-washing course according to the first embodiment of the present invention may include a cabinet 5 forming an external appearance, a tub 3 disposed inside the cabinet 5 and containing washing water, a drum 9 rotatably mounted inside the tub 3 and receiving laundry, a driving motor 7, 8 for rotating the drum 9, a rotation shaft 17 for transferring a rotation force of the driving motor 7, 8 to the drum 9, a bearing 11 for supporting the rotation shaft 17, a sealing member 13 for preventing a leakage of water between the tub 3 and the drum 9 into the bearing 11, a detergent supply unit 30 for supplying water mixed with detergent to the tub 3, a water supply unit 20 having a plurality of valves for supplying or suspending water to the detergent supply unit 30, a drain pump 40 for pumping water contained in the tub 3 to the outside, and a control panel 70 for receiving an inputting of a manipulation command from a user so as to control an entire operation of the washing machine.

A door 1 is disposed at a front of the cabinet 5, and a gasket 2 is mounted between the door 1 and the tub 3.

A stopping spring 4 for supporting the tub 3 is disposed between an upper inner surface of the cabinet 5 and an upper side of an outer circumferential surface of the tub 3, and a friction damper 10 for reducing vibration of the tub 3 is disposed between a lower inner surface of the cabinet 5 and a lower side of the outer circumferential surface of the tub 3.

A plurality of lifters 9*a* are installed inside the drum 9 so as to lift up and down the laundry.

The driving motor 7, 8 may include a stator 7 serving as a direct drive (DD) motor and having a coil wound onto a slot, and a rotor 8 rotating at an outer circumferential surface of the stator 7 and having a permanent magnet 12 therein.

The stator 7 is coupled to a rear wall of the tub 3 by a plurality of coupling members 19.

The rotor 8 is coupled at a rear end of the rotation shaft 17 by a coupling member 18.

If power is applied to the coil of the stator 7, the stator 7 is electromagnetized and interacts with the permanent magnet 12 that is attached inside the rotor 8, thereby rotating the rotor 8. The rotation force of the rotor 8 is transferred to the drum 9 via the rotation shaft 17.

The bearing 11 is installed inside a bearing housing 15, and includes a front bearing disposed at the front of the rotation shaft 17 and a rear bearing disposed at the rear of the rotation shaft 17.

The sealing member 13 is installed on an outer circumference of the rotation shaft 17 so as to insert the rotation shaft 17, thereby preventing a leakage of water between the tub 3 and the drum 9 into the bearing 11.

The detergent supply unit 30 is configured to mix supplied water with detergent, thus to supply the same to the tub 3 via a supply pipe 31. For instance, the detergent supply unit 30 may be configured to have a case, and a detergent container disposed inside the case and storing a variety of detergents therein.

A siphon pipe is formed at a bottom of the detergent container. A water supply inlet connected to a connection pipe 22 is formed at an upper side of the case, and a detergent outlet (not shown) connected to the supply pipe 31 is formed at a bottom of the case.

With the above-described configuration, water supplied through the connection pipe 22 is mixed with the detergent stored in the detergent container, and then comes out of the detergent container at a certain water level via the siphon pipe. The water mixed with the detergent, coming out of the detergent container, is supplied to the tub 3 via the supply pipe 31.

The water supply unit 20 may include a supply pipe 21 connected to an external source of water supply (hot water or cold water), and the connection pipe 22 connected to the detergent supply unit 30.

The drain pump 40 may include a drain pipe 41 connected to a lower side of the tub 3, and a connection pipe 42 connected to an external drain.

Referring to FIG. 2, the control panel 70 is provided with a towel-washing course button 71 which allows a user to select an option for a towel-washing course if the laundry is towel. The towel-washing course button 71 enables the rinse process to be performed according to the type of laundry, i.e., towel, thereby solving a problem of detergent remnants in the towel.

Hereinafter, description of the operation method for the towel-washing course will be given in detail according to the first embodiment of the present invention.

FIG. 3 is a block-diagram showing the operation method for the towel-washing course according to the first embodiment of the present invention.

Referring to FIGS. 1 and 3, the operation method for the towel-washing course according to the first embodiment of the present invention may include a washing process S10 for washing a towel, a rinse process S20 for rinsing the towel by supplying water after performing the washing process and including a remaining water removal process S44, and a final dehydration process S30 for dehydrating the towel after performing the rinse process. Here, a process for allowing the user to press the towel-washing course button 71 may be further included such that the towel-washing course is manually started.

In the washing process S10, the detergent supply unit 30 is configured to mix water supplied from the water supply unit 20 with the detergent, and to supply the water mixed with the detergent to the tub 3 via the supply pipe 31. Next, the driving motor 7, 8 is configured to rotate the drum 9 in a clockwise or counter-clockwise direction, thereby washing the towel in a dropping or reciprocal friction manner.

The rinse process S20 is repeated for plural times between the washing process S10 and the final dehydration process S30 so as to enhance the rinsing performance. In this embodiment, the rinse process S20 includes a first rinse process S21, a second rinse process S22, a third rinse process S23, and a fourth rinse process S24, thereby performing the rinse process of the same cycle for 4 times. In general, the rinse process is repeated for 3 times, but in this embodiment, the rinse process was repeated for 4 times so as to enhance the rinsing performance. To be certain, the rinse process may be repeated for more than 4 times for much enhanced rinsing performance.

The first, second, third and fourth rinse processes S21, S22, S23 and S24 are configured to be sequentially performed. In each of the four rinse processes S21~S24, steps of drain S41, intermittent dehydration S42, main dehydration S43, remaining water removal process S44, water supply S45 and rinse S46 are sequentially performed.

The drain S41 refers to a step, in which the drain pump 40 discharges washing water in the lower side of the tub 3 to the outside via the drain pipe 41 and the connection pipe 42.

The intermittent dehydration S42 refers to a step, in which, before proceeding to the main dehydration S43, the driving motor 7, 8 dehydrates the laundry while rotating the drum 9 at a low speed (350-400 rpm) in the clockwise or counter-clockwise direction. This intermittent dehydration S42 disentangles the tangled laundry, thereby preventing an unbalanced state of the drum 9, thus to prevent an occurrence of vibration and noise when dehydrating the laundry.

The main dehydration S43 refers to a step which dehydrates the towel by rotating the drum 9 at a high speed after performing the intermittent dehydration S42. Here, in order to enhance the rinsing performance for the towel, the towel is dehydrated at a spin speed of 900 rpm or 1100 rpm, which is greater than the spin speed (800 rpm) of the drum 9 in the main dehydration process for general laundry.

The remaining water removal process S44 refers to a process which removes detergent solution remaining inside the washing machine after performing the main dehydration S43. For this, the remaining water removal process S44 may include a water supply step S61 in which the water supply unit 20 supplies water to the tub 3 via the detergent supply unit 30 and the supply pipe 31, a water supply suspension step S62 for suspending the water supply, and a drain step S63 which operates the drain pump 40 to discharge the remaining water to the outside via the drain pipe 41 connected to the lower side of the tub 3. Thus, the rinse process S20 includes the remaining water removal process S44, through which the detergent solution with a certain concentration would be removed from the washing machine after the main dehydration S43 is completed. As clean water is supplied, the rinse process of the towel is performed smoothly. In addition, a problem of having detergent remnants in the towel even after being rinsed can be solved.

The water supply S45 refers to a step, in which the water supply unit 20 supplies water to the tub 3 via the supply pipe 31. Here, in order to enhance the rinsing performance for the towel, a water level of 22 kHz or 23 kHz, higher than a water level (23.2 kHz) for the general laundry, is supplied to the towel. For reference, a level (23.2 kHz) of water supply measured by a water level sensor indicates approximately 25 L of water in a washing machine having a capacity of 10 kg, and a level (22.7 kHz) of water supply indicates approximately 30 L of water in the washing machine having a capacity of 10 kg. Accordingly, rinsing the towel requires greater amount of water as compared to that for the general laundry.

In addition, rinse temperature for the towel is in the range of 50° C.~60° C., relatively higher than that (40° C.) used to rinse the general laundry. For this, the water supply unit 20 is configured to mix the cold water and the hot water at an appropriate ratio. Thus, the towel is rinsed at a temperature higher than the general laundry, thereby enhancing the rinsing performance.

The rinse S46 refers to a step, in which the driving motor 7, 8 rotates the drum 9 in the clockwise or counter-clockwise direction so as to rinse the laundry.

Here, in order to enhance the rinsing performance for the towel, the towel has a rinse time of 8 or 12 minutes, which is longer than that of 4 minutes for the general laundry.

FIG. 4 is a block diagram showing an operation method for the towel-washing course according to a second embodiment of the present invention.

Referring to FIGS. 1 and 4, the operation method for the towel-washing course according to the second embodiment of the present invention may include a washing process S10 for washing a towel, a rinse process S20' for rinsing the towel by supplying water after performing the washing process S10 and including a remaining water removal process S44, and a final dehydration process S30 for dehydrating the towel after performing the rinse process S20'. Here, an operation for allowing the user to press the towel-washing course button 71 may be further included such that the towel-washing course is manually started.

In the washing process S10, the detergent supply unit 30 is configured to mix the water supplied from the water supply unit 20 with detergent, and then to supply the water mixed with the detergent to the tub 3 via the supply pipe 31. Then, the driving motor 7, 8 rotates the drum 9 in the clockwise or counter-clockwise direction, thereby washing the towel in a dropping or reciprocal friction manner.

The rinse process S20' is repeated for plural times between the washing process S10 and the final dehydration process S30 so as to enhance the rinsing performance. In this embodiment, the rinse process S20' includes: a first rinse process S21', a second rinse process S22', a third rinse process S23' and a fourth rinse process S24'. In general, the rinse process is repeated for 3 times, but in this embodiment, the rinse process was repeated for 4 times so as to enhance the rinsing performance. To be certain, the rinse process may be repeated for more than 4 times for much enhanced rinsing performance.

The first, second, third and fourth rinse processes S21'~S24' are sequentially performed.

In the first rinse process S21', steps of drain S41, intermittent dehydration S42, main dehydration S43, remaining water removal process S44, water supply S45 and rinse S46 are sequentially performed. Meanwhile, in the second through fourth rinse processes S22'~S24', steps of drain S51, intermittent dehydration S52, main dehydration S53, water supply S54 and rinse S55 are sequentially performed.

The drain S41 and S51 refers to the step, in which the drain pump 40 discharges washing water in the lower side of the tub 3 to the outside via the drain pipe 41 and the connection pipe 42.

The intermittent dehydration S42 and S52 refers to the step, in which, before proceeding to the main dehydration S43, the driving motor 7, 8 dehydrates the towel while rotating the drum 9 at a low speed (350-400 rpm) in the clockwise or counter-clockwise direction. This intermittent dehydration S42, S52 disentangles the tangled towel, thereby preventing an unbalanced state of the drum 9, thus to prevent an occurrence of vibration and noise when dehydrating the laundry.

The main dehydration S43 and S53 refers to the step which dehydrates the towel by rotating the drum 9 at a high speed after performing the intermittent dehydration S42 and S52. Here, in order to enhance the rinsing performance for the towel, the towel is dehydrated at a spin speed of 900 rpm or 1100 rpm, which is greater than the spin speed (800 rpm) of the drum 9 in the main dehydration process for general laundry.

The remaining water removal process S44 refers to a process which removes detergent solution remaining inside the washing machine after performing the main dehydration S43. For this, the remaining water removal process S44 may include a water supply step S61 in which the water supply unit 20 supplies water to the tub 3 via the detergent supply unit 30 and the supply pipe 31, a water supply suspension step S62 for suspending the water supply, and a drain step S63 which operates the drain pump 40 to discharge the remaining water to the outside via the drain pipe 41 connected to the lower side of the tub 3.

Thus, the rinse process S20' includes the remaining water removal process S44, through which the detergent solution with a certain concentration would be removed from the washing machine after the main dehydration S43 is completed. As clean water is supplied, the rinse process of the towel is performed smoothly. In addition, the problem of having detergent remnants in the towel even after being rinsed can be solved.

Meanwhile, in the second embodiment of the present invention, the remaining water removal process S44 is included only in the first rinse process S21'. This is because the first rinse process S21' is performed immediately after the washing process S10, the greatest amount of the detergent solution would remain inside the washing machine. Accordingly, performing the remaining water removal process S44 only in the first rinse process S21' enables to remove an amount of water supply for removing the remaining water as well as to enhance the remaining water removal effect.

The water supply S45 and S54 refers to the step, in which the water supply unit 20 supplies water to the tub 3 via the supply pipe 31. Here, in order to enhance the rinsing performance for the towel, a water level of 22 kHz or 23 kHz, higher than a water level (23.2 kHz) for the general laundry, is supplied to the towel. For reference, the level (23.2 kHz) of water supply measured by a water level sensor indicates approximately 25 L of water in a washing machine having a capacity of 10 kg, and the level (22.7 kHz) of water supply indicates approximately 30 L of water in the washing machine having a capacity of 10 kg. Accordingly, rinsing the towel requires greater amount of water as compared to that for the general laundry.

In addition, rinse temperature for the towel is in the range of 50° C.~60° C., relatively higher than that of 40° C. used to rinse the general laundry. For this, the water supply unit 20 is configured to mix the cold water and the hot water at an appropriate ratio. Thus, the towel is rinsed at a temperature higher than the general laundry, thereby enhancing the rinsing performance.

The rinse S46 and S55 refers to the step, in which the driving motor 7, 8 rotates the drum 9 in the clockwise or counter-clockwise direction so as to rinse the towel.

Here, in order to enhance the rinsing performance for the towel, the towel has a rinse time of 8 or 12 minutes, which is longer than that of 4 minutes for the general laundry. Accordingly, the towel is rinsed for a longer period of time than the general laundry, thereby enhancing the rinsing performance.

As so far described, the operation method for the towel-washing course in a washing machine according to the present invention is provided with the rinse process including the remaining water removal process between the main dehydration process and the water supply process. Accordingly, through the remaining water removal process, the detergent solution with a certain concentration remaining inside the washing machine can be removed after the main dehydration is completed. As clean water is supplied, the rinse process of the towel is smoothly performed, thus to solve the problem of detergent remnants in the towel after the rinse process.

In addition, the towel is dehydrated at the spin speed of 900 rpm or 1100 rpm, which is greater than the spin speed (800 rpm) of the drum 9 in the main dehydration process for general laundry, the water level of 22 kHz or 23 kHz, which is higher than the water level (23.2 kHz) for the general laundry, is supplied to the towel, the towel has a rinse time of 8 or 12 minutes, which is longer than that of 4 minutes for the general laundry, and rinse temperature for the towel is in the range of 50° C.~60° C., relatively higher than that of 40° C. used to rinse the general laundry. Accordingly, the rinse process is smoothly performed, thereby solving the problem of detergent remnants in the towel after being rinsed.

As the present invention may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. An operation method for a towel-washing course in a washing machine, comprising:

a washing process for washing a detergent retaining towel including supplying water and detergent;

a first rinse process sequentially performed through only the steps of draining of the supplied water in the washing process, intermittent dehydration, main dehydration, remaining detergent removal process, water supply, and rinse;

one or more additional rinse processes following the first rinse process sequentially performed through only the steps of intermittent dehydration, main dehydration, water supply, and rinse; and a final dehydration process for dehydrating the towel, wherein the remaining detergent removal process is performed in an order of water supply, water supply suspension, and drain, and wherein the intermittent dehydration step includes rotating a dram of the washing machine between 350 and 400 rpm, and the main dehydration step includes rotating the dram between 900 and 1100 rpm.

2. The operation method of claim 1, wherein a rinse time in each rinse step is for 8 or 12 minutes.

3. The operation method of claim 1, wherein rinse temperature in each rinse step is in the range of 50° C. and 60° C.

* * * * *